US008181816B2

(12) United States Patent
Allen

(10) Patent No.: US 8,181,816 B2
(45) Date of Patent: May 22, 2012

(54) FLEXIBLE DRINKING CUP

(76) Inventor: Laurie Allen, Edgewater, NJ (US)

( * ) Notice: Subject to any disclaimer, the term of this patent is extended or adjusted under 35 U.S.C. 154(b) by 566 days.

(21) Appl. No.: 12/357,730

(22) Filed: Jan. 22, 2009

(65) Prior Publication Data

US 2009/0188927 A1 Jul. 30, 2009

Related U.S. Application Data

(60) Provisional application No. 61/023,513, filed on Jan. 25, 2008.

(51) Int. Cl.
*A47G 19/22* (2006.01)

(52) U.S. Cl. ..... 220/703; 220/669; 206/218; 206/219; 215/382

(58) Field of Classification Search ..... 206/218, 206/219; 220/669, 703; 215/382
See application file for complete search history.

(56) References Cited

U.S. PATENT DOCUMENTS 4,875,576 A * 10/1989 Torgrimson et al. ..... 206/219
5,762,230 A * 6/1998 Policappelli ..... 220/62.12
2007/0062961 A1* 3/2007 Rigas ..... 220/703

* cited by examiner

*Primary Examiner* — Anthony Stashick
*Assistant Examiner* — Elizabeth Volz
(74) *Attorney, Agent, or Firm* — Michaud-Kinney Group LLP

(57) ABSTRACT

A drinking cup usable by persons having limited physical faculties includes a vessel portion having one or more walls and being closed at a bottom end to define a bottom surface, the vessel portion being configured to retain a liquid; a drinking portion having one or more walls and an open top end from which the liquid located in the vessel portion can be removed, the open top end defining a rim; and a flexible member connecting the vessel portion and the drinking portion. The flexible member facilitates movement of the drinking portion relative to the vessel portion.

5 Claims, 3 Drawing Sheets

FLEXIBLE DRINKING CUP

CROSS REFERENCE TO RELATED APPLICATION

This application claims the benefits of U.S. Patent Application Ser. No. 61/023,513, filed on Jan. 25, 2008, entitled "Flexible Drinking Cup," the contents of which are incorporated by reference herein in their entirety.

TECHNICAL FIELD

The present invention relates generally to drinking cups and, more particularly, to a drinking cup having a drinking portion that is flexibly attached to a vessel portion to allow for the drinking portion to be moved relative to the vessel portion.

BACKGROUND OF THE INVENTION

When drinking from a conventional cup, it is generally necessary for a user to put his lips on the rim of the cup, tilt his head back while maintaining the contact between his lips and the rim of the cup, and turn his mouth upward while raising and tilting the cup itself a suitable amount to direct the liquid into his mouth. In raising the cup, the level of liquid is raised above the user's open mouth, and in tilting the cup the liquid is poured into the open mouth.

Both the raising of the cup and the pouring of liquid from the cup can pose obstacles to users having limited physical faculties. For example, a disabled person with limited upper body mobility may have difficulty raising his arms to bring a cup to his mouth, difficulty tilting his head back to drink, or both. A person with Parkinson's disease may have difficulty in maintaining the cup steady enough to pour the liquid into his mouth without spilling it. Any person bedridden and unable to sit up or who must remain laying on his side or front would also find it difficult, if not impossible, to drink from a cup. Additionally, persons having dental devices in their mouths or those without teeth may also have difficulty drinking from conventional cups.

At least some of these issues can still be present when the user drinks from a cup using a straw, assistive mouthpiece, or similar apparatus. In particular, the use of some assistive mouthpieces still involves tilting the head back to pour the liquid into the mouth. Furthermore, the sucking ability required for the use of a straw can be difficult for some users depending upon their particular disabilities.

Based on the foregoing, it would be desirable to have a cup that can be utilized by persons of limited physical faculties to promote their independence and facilitate their self reliance with regard to the drinking of liquids.

SUMMARY OF THE PRESENT INVENTION

In one aspect, the present invention resides in a drinking appliance such as a drinking cup. Such a cup includes a vessel portion having one or more walls and being closed at a bottom end to define a bottom surface and a drinking portion having one or more walls and an open top. The vessel portion holds the liquid, and the liquid is poured from the open top. A flexible member connects the vessel portion and the drinking portion and allows the drinking portion to be moved relative to the vessel portion.

In another aspect, the present invention resides in a flexible drinking cup. This flexible drinking cup includes a bottom vessel portion for holding a liquid and a top drinking portion flexibly connected to the bottom vessel portion. The top drinking portion directs the liquid from the bottom portion to the mouth of a user. In use, the top drinking portion can be offset from the bottom vessel portion to enable a person having limited physical faculties (or any person) to drink from the cup without fully tilting the cup or without fully tilting his head to receive the liquid from the top drinking portion.

In another aspect, the present invention resides in an articulated drinking cup. As used herein, the term "articulated" means a joint between two members that allows the members to move relative to each other. The articulated drinking cup includes a vessel portion that retains a liquid and has one or more walls and is closed at a bottom end to define a bottom surface. This cup also includes a drinking portion having one or more walls and an open top end from which the liquid can be removed. The open top end defines a rim having a drinking edge, portions located at opposing ends of the drinking edge that extend out of a plane coincident with the drinking edge, and a cutout located opposite the drinking edge. The articulation of the top drinking portion and the bottom vessel portion derives from a member that connects the vessel portion and the drinking portion to allow the vessel portion and the drinking portion to flex relative to one another. This flexing facilitates drinking from the cup by a user having limited physical capacities.

In any form, the drinking cup of the present invention is usable by persons having limited or impaired physical capacities. The flexibility of the upper drinking portion relative to the lower vessel portion in which liquid is contained obviates or lessens the need for the user to tilt the head back in a manner that is consistent with typical drinking cups. Also, there is no need (or less of a need) to tip the cup itself to the same degree as a typical drinking cup. This also obviates the need for straws or mouthpieces, which thereby removes the need for the user to suck through a straw or mouthpiece. Accordingly, the drinking cup of the present invention facilitates the independence of the user. Users that may be particularly helped by use of the drinking cup of the present invention include, but are not limited to, patients with Parkinson's disease, physically-challenged people, injured people, people with chronic illnesses and/or limited mobility, patients in hospitals, bedridden patients, children, and the like.

DETAILED DESCRIPTION OF THE PREFERRED EMBODIMENTS

Figure 1:
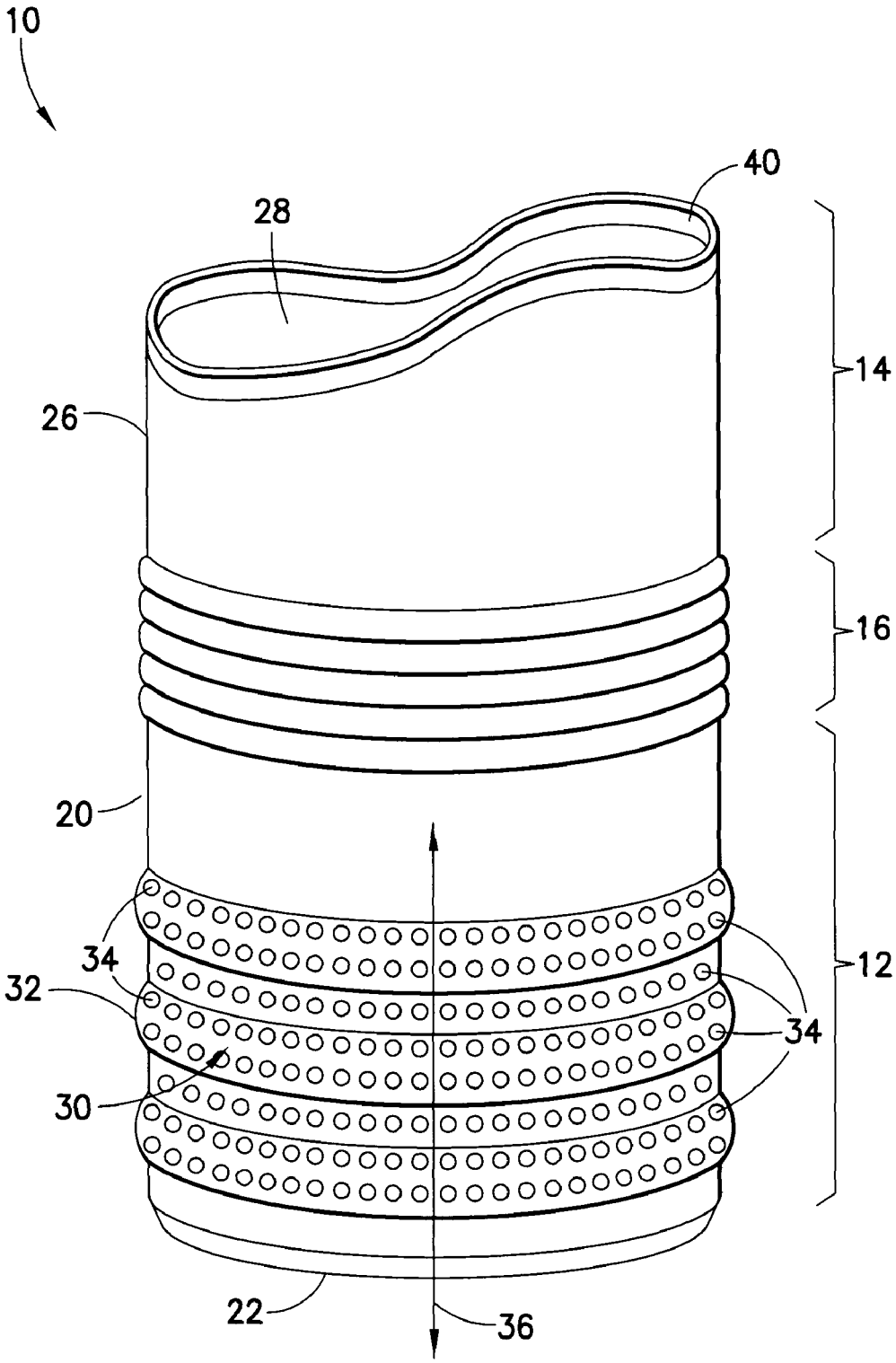
FIG. 1 is a perspective view of a drinking cup of the present invention.
Figure 2:
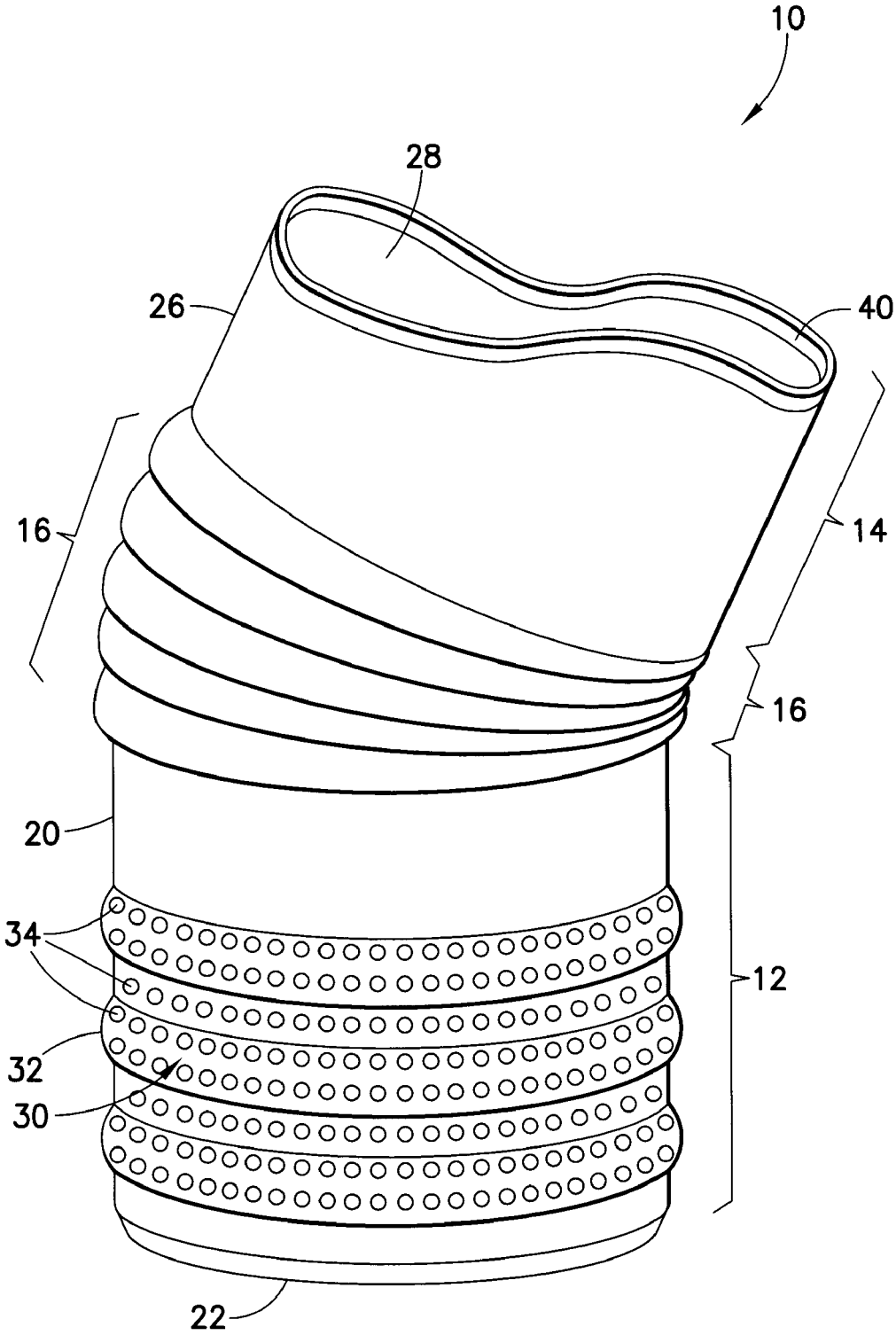
FIG. 2 is a perspective view of the drinking cup of FIG. 1 showing the drinking portion thereof flexibly offset relative to the vessel portion thereof.

As is shown with reference to FIGS. 1 and 2, a drinking cup of the present invention is designated generally by the reference numeral 10 and is hereinafter referred to as "cup 10." Cup 10 comprises a vessel portion 12 in which a liquid can be contained, a drinking portion 14 from which a user can drink, pour, or otherwise remove the liquid from the vessel portion, and a flexible member 16 connecting the vessel portion and the drinking portion such that the vessel portion and the drinking portion are connected in an articulated configuration. The cup 10 as defined by the vessel portion 12, the drinking portion 14, and the flexible member 16 is a substantially cylindrical object. The vessel portion 12 includes one cylindrical wall 20 closed at one end to form a substantially flat bottom surface 22 that allows the cup 10 to be supported on a suitable surface. The drinking portion 14, which also includes one cylindrical wall 26, includes an open bottom that is connected to the vessel portion 12 and an open top 28 through which the liquid can be removed from the cup 10. The present invention is not limited to either the vessel portion 12 or the drinking portion 14 being defined by only one cylindrical wall, however, as either or both the vessel portion and the drinking portion can comprise two or more walls (e.g., eight walls to define the cup as being octagonal in cross section).

An outer surface of the vessel portion 12 includes texturing or the like on an outer surface of said cylindrical wall 20 for facilitating the gripping of the cup 10. As is shown, texturing of this outer surface includes a grip 30 having raised ridges 32 and bumps 34 disposed thereon. The raised ridges 32 extend perpendicularly with respect to a longitudinal axis 36 coincident with the cylindrical form of the cup 10. The grip 30, however, is not limited to the combination of raised ridges 32 and bumps 34, as either the raised ridges or the bumps can be used individually. Also, other surfaces that facilitate the gripping of the cup are within the scope of the present invention. Such other surfaces include, but are not limited to, grooves, knurling, knobs, dimples, depressions that approximate the shape of fingers, combinations of the foregoing, and the like.

The grip 30 is also fabricated from a material that is conducive to being gripped. Such a material includes rubber, foam, or any suitable elastomeric material. The material of the grip 30 is not so limited, however, as other materials such as plastics, papers, and cloth are within the scope of the present invention. In one exemplary embodiment, the grip 30 is fabricated from a suitable elastomeric material having the desired surface configuration and stretched over the vessel portion 12 of the cup 10. The cup 10 is also not limited in this regard, as the grip 30 may be attached to the cup in any suitable manner or be made to be integral therewith.

The drinking portion 14 forms the open top 28 of the cup 10 from which the user may drink, pour, or otherwise remove the liquid. This open top 28 is defined by a rim 40.

In the embodiment described herein, the flexible member 16 is a stretchable ribbed ring or band that may resemble a bellows. When the flexible member 16 is used to connect the bottom end of the drinking portion 14 to the top end of the vessel portion 12, the drinking portion can be offset relative to the vessel portion as is shown in FIG. 2, thereby allowing the user to tilt the drinking portion to drink therefrom without having to tilt the vessel portion any appreciable amount.

Figure 3:
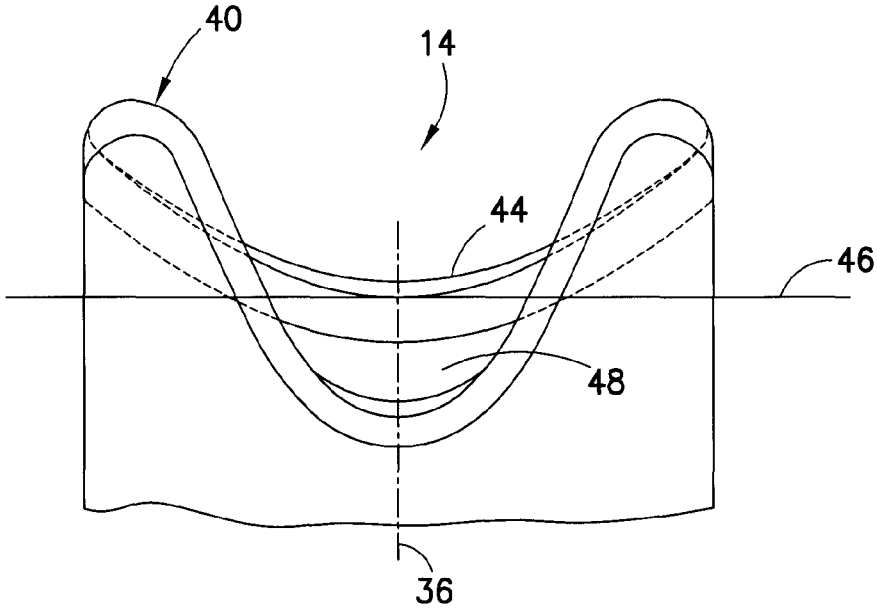
FIG. 3 is a perspective view of the drinking portion of the drinking cup.

As is shown in FIG. 3, the rim 40 is defined by an irregularly contoured edge. A drinking portion of the rim 40 is substantially straight to allow the user to drink therefrom and is hereinafter referred to as "the drinking edge 44." As used herein, the term "substantially straight" means not substantially curved in a plane indicated by line 46 coincident with the drinking edge 44 wherein the plane indicated by line 46 extends parallel to the longitudinal axis 36 of the cup 10. Two portions of the rim 40, one on either side of the drinking edge 44, extend slightly out of the plane indicated by line 46 to facilitate in directing liquid to the drinking edge. Another portion of the rim 40 (opposite the drinking edge 44) extends down and out of the plane indicated by line 46 to provide a "cutaway" section 48 in the rim, which is a cutout that can accommodate the user's nose if the cup 10 is tilted in the direction of the user's face. The rim 40 is not limited to the configuration shown, however, and other configurations in which the various portions of the rim are contoured to other degrees are within the scope of the present invention.

Figure 4:
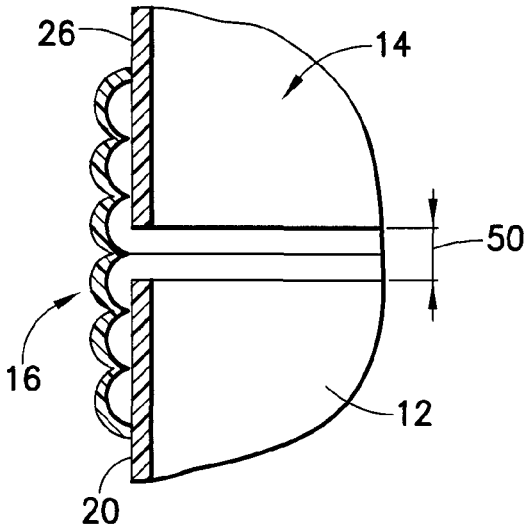
FIG. 4 is a sectional view of the attachment of the drinking portion to the vessel portion.

As is shown in FIG. 4, the drinking portion 14 is flexibly connected to the vessel portion 12 via the flexible member 16. The flexible member 16 can be an elastic material fabricated into a cylinder form that is open on opposing ends to accommodate the drinking portion 14 and the vessel portion 12. Stitching or other manipulation of the material of the cylinder form can be used to define "ribs" that are laterally oriented with respect to the longitudinal axis 36 extending through the vessel portion 12 and drinking portion 14 and which facilitate the movement of one end of the flexible member relative to the other end of the flexible member.

An upper end of the flexible member 16 is stretched over the cylindrical wall 26 of the drinking portion 14. A lower end of the flexible member 16 is also stretched over the cylindrical wall 20 of the vessel portion 12. The ends of the flexible member 16 are stretched over each portion such that a gap 50 is defined between a lower edge of the cylindrical wall 26 and an upper edge of the cylindrical wall 20, which thereby allows for movement of the drinking portion 14 relative to the vessel portion 12. Stretching of the flexible member 16 over the cylindrical walls effects a tight seal with the drinking portion 14 and the vessel portion 12, thereby preventing leakage of liquid around the flexible member 16 and outside the cup 10. Irrespective of the manner in which the flexible member 16 is attached to the vessel and drinking portions, the flexible member is preferably connected to the vessel and drinking portions proximate the gap 50 to limit the amount of liquid that contacts and may seep into the interface of the flexible member and the outer surfaces of the vessel and drinking portions.

Figure 5:
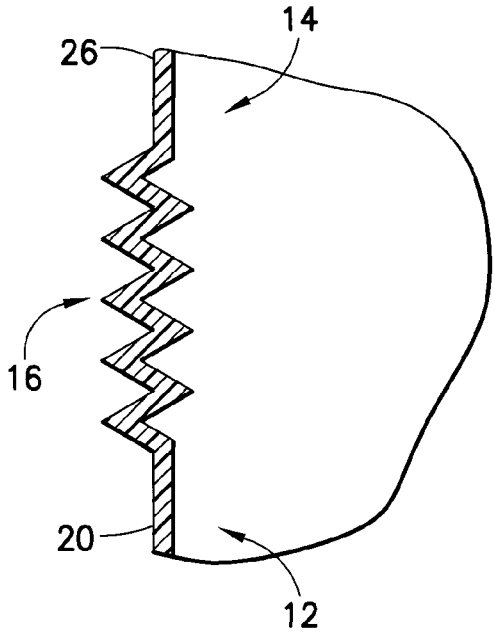
FIG. 5 is a sectional view of a pleated member connecting the drinking portion and the vessel portion.

The present invention is not limited to embodiments in which the flexible member 16 is stretched over the vessel portion 12 and the drinking portion 14 to define a gap, however, as the flexible member may be integrally formed with the vessel and drinking portions, as is shown in FIG. 5. In particular, the flexible member 16 can be attached to the outer surface of the cylindrical wall 26 and the outer surface of the cylindrical wall 20 using heat welding, ultrasonic welding, an adhesive, combinations of any of the foregoing, and the like. Furthermore, the flexible member 16 may be integral with the vessel and drinking portions (e.g., directly molded as a unitary piece) and formed of a material that is pleated or the like (e.g., as in the material from which "flexible" drinking straws are made.)

In any embodiment, the cup 10 can be fabricated from materials that are non-breakable and dishwasher-safe.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the following claims.

The invention claimed is:

1. An articulated drinking cup, comprising:

a vessel portion comprising one or more walls and being closed at a bottom end to define a bottom surface, said vessel portion being configured to retain a liquid;

a drinking portion comprising one or more walls and having an open top end from which said liquid located in said vessel portion can be removed, said open top end defining a rim comprising a drinking edge, portions located at opposing ends of said drinking edge that extend out of a plane coincident with said drinking edge, and a cutout located opposite said drinking edge; and a member connecting said vessel portion and said drinking portion in an articulated manner to allow said vessel portion and said drinking portion to move relative to one another;

wherein the moving of said vessel portion relative to said drinking portion facilitates drinking from said articulated drinking cup by a user having limited physical capacities.

2. The articulated drinking cup of claim 1, wherein said member connecting said vessel portion and said drinking portion in an articulated manner is an arrangement of pleated material.

3. The articulated drinking cup of claim 1, further comprising a textured surface on said vessel portion to facilitate gripping by said user.

4. The articulated drinking cup of claim 1, wherein said member connecting said vessel portion and said drinking portion in an articulated manner is an elastomeric material.

5. The articulated drinking cup of claim 4, wherein said elastomeric material is ribbed.

* * * * *